US007303330B2

(12) United States Patent
Hartzband

(10) Patent No.: US 7,303,330 B2
(45) Date of Patent: Dec. 4, 2007

(54) WATCH WRISTBAND WITH LINKS

(75) Inventor: Paul Hartzband, Chappaqua, NY (US)

(73) Assignee: Hartcase Corporation, Purchase, NY (US)

( * ) Notice: Subject to any disclaimer, the term of this patent is extended or adjusted under 35 U.S.C. 154(b) by 134 days.

(21) Appl. No.: 10/546,969

(22) PCT Filed: Feb. 24, 2003

(86) PCT No.: PCT/US03/05940

§ 371 (c)(1),
(2), (4) Date: Aug. 23, 2005

(87) PCT Pub. No.: WO2004/077173

PCT Pub. Date: Sep. 10, 2004

(65) Prior Publication Data

US 2006/0208017 A1 Sep. 21, 2006

(51) Int. Cl.
*G04B 37/14* (2006.01)
*A44C 5/02* (2006.01)

(52) U.S. Cl. ..... 368/282; 24/265 WS; 224/164

(58) Field of Classification Search ..... 368/281, 368/282; 24/265 WS, 265 B; 63/3, 21; 224/164; 59/82, 84
See application file for complete search history.

(56) References Cited

U.S. PATENT DOCUMENTS 3,965,670 A 6/1976 Ihringer
4,706,857 A * 11/1987 Aellen et al. ..... 224/164
4,723,406 A * 2/1988 Ripley ..... 59/79.1
6,026,637 A * 2/2000 Dombre et al. ..... 59/80
6,318,064 B2 * 11/2001 Vandini ..... 59/80
6,488,404 B2 12/2002 Zürcher et al.
6,494,030 B2 * 12/2002 Cazard ..... 59/80
7,043,895 B2 * 5/2006 Mace ..... 59/80

FOREIGN PATENT DOCUMENTS

CH 653871 A5 * 1/1986
CH 659 571 A5 2/1987
CH 664 475 A5 3/1988
CH 692 234 A5 4/2002

* cited by examiner

*Primary Examiner*—Vit Miska
*Assistant Examiner*—Jeanne-Marguerite Goodwin
(74) *Attorney, Agent, or Firm*—McGlew and Tuttle, P.C.

(57) ABSTRACT

The invention concerns a watch wristband of the type including at least one row of central links (10) of longitudinal axis AA, two rows of pairs of lateral links (11) facing each other symmetrically with respect to the axis in order to connect the central links (10) to each other and a plurality of lugs (24) assembling the central links with the lateral links in an articulated manner. This wristband is characterized in that each central link (10) includes a core (12), a layer of carbon fiber fabric (13) covering the core and two flanges (15) respectively secured to the faces of the core connection to the lateral links.

20 Claims, 3 Drawing Sheets

WATCH WRISTBAND WITH LINKS

Figure 1:
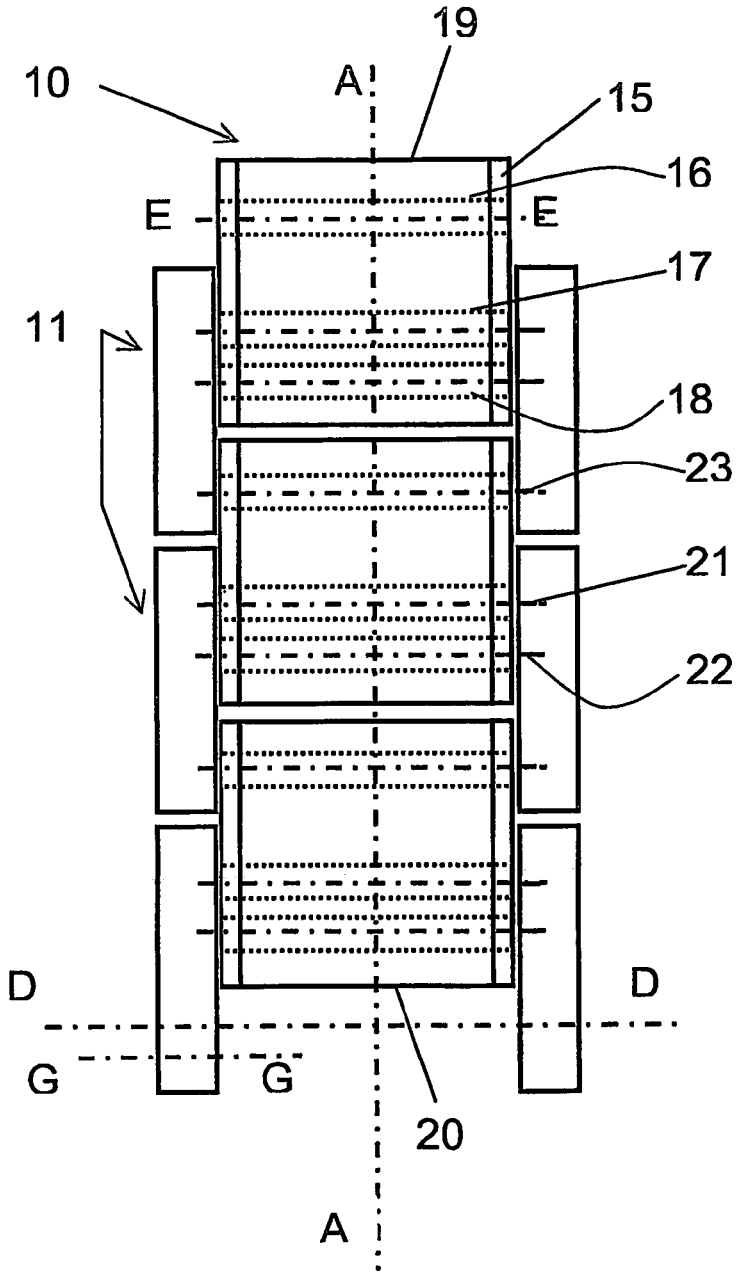

The present invention relates to the watchmaking field and concerns, more particularly, a watch wristband or bracelet with articulated links.

Numerous wristbands of this type are available on the market, most often made of steel or another metal. For example, Swiss Patent No. CH 692 234 discloses a wristband having two rows of lateral links and at least one row of central links, connected in an articulated manner by pins. The central links include cores made of plastic material intended to reduce friction between the various mobile parts of the wristband.

This solution is certainly advantageous. Nonetheless, since certain watches now have a dial with a carbon fibre appearance, combining such a dial with a totally metal wristband does not give a very satisfactory aesthetic result.

Moreover, most articulated wristband systems devised for metal links are not ideally suited to solid carbon elements since the latter are liable to erode due to friction with the metal elements.

The object of the present invention is to provide a wristband formed of metal parts and solid carbon parts avoiding the problems of friction between the two materials while maintaining an excellent aesthetic appearance.

More precisely, the invention concerns a watch wristband of the type comprising at least one row of central links, two rows of pairs of lateral links facing each other symmetrically with respect to the longitudinal axis of the wristband in order to, connect the central links to each other and a plurality of lugs assembling the central links to the lateral links in an articulated manner. This wristband is mainly characterized in that each central link comprises, at least, an external portion including solid carbon and two flanges respectively secured to the faces of the core connected to the lateral links The wristband according to the invention also includes the following features:

- each central link comprises a core and a layer of carbon fibre fabric covering said core;
- the core of the central links is made of carbon fibre whereas the flanges are made of metal;
- the central links have the shape of a rectangular plate whose transverse axis is perpendicular to the longitudinal axis of the wristband;
- three passages pass through each central link, parallel to its median plane and its transverse axis;
- the lateral links have, overall, the shape of a plate whose transverse axis is parallel to the transverse axis of the central links;
- each lateral link is pierced with three holes parallel to its median plane and to its transverse axis, these holes being arranged such that:
  - the first passage of a central link is aligned with the third holes of a pair of lateral links whose second and first holes are respectively aligned with the second and third passages of the adjacent central link; and
  - the second and third passages of the same central link are respectively aligned with the second and third holes of a pair of lateral links whose third holes are aligned with the first passage of the other adjacent central link;
- the lugs are arranged in the three passages of the central links and driven into the holes of the corresponding lateral links;

- the second passage of a central link has a constant diameter, whereas the first and third passages have a slightly greater diameter where they pass through the core;
- the central and lateral links have an oval cross-section;
- the wristband includes two rows of central links and a third row of lateral links inserted between the central links fulfilling, on either side, the same connecting function as the two others.

Figure 2:
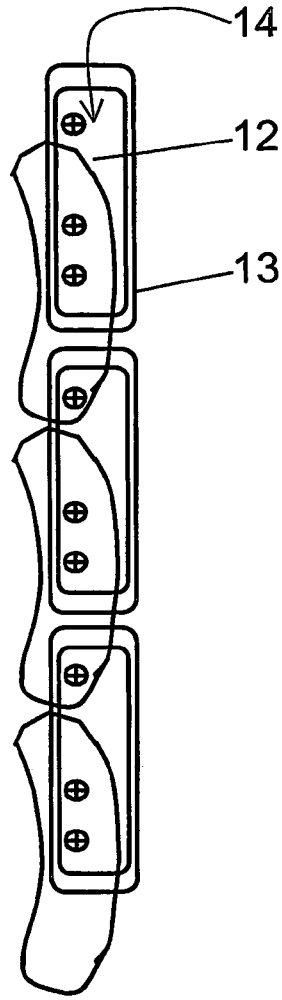
Figure 3:
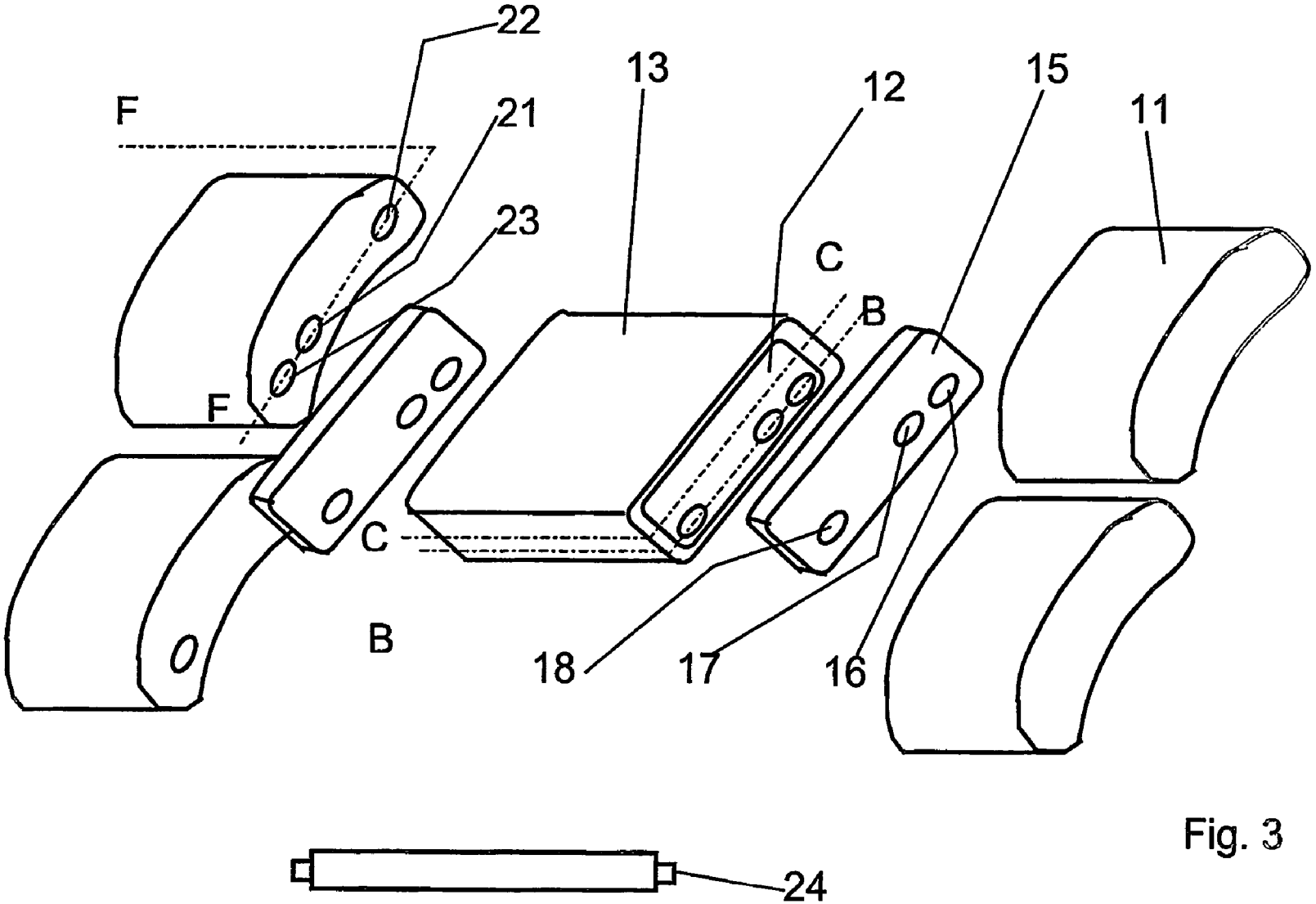
Figure 4:
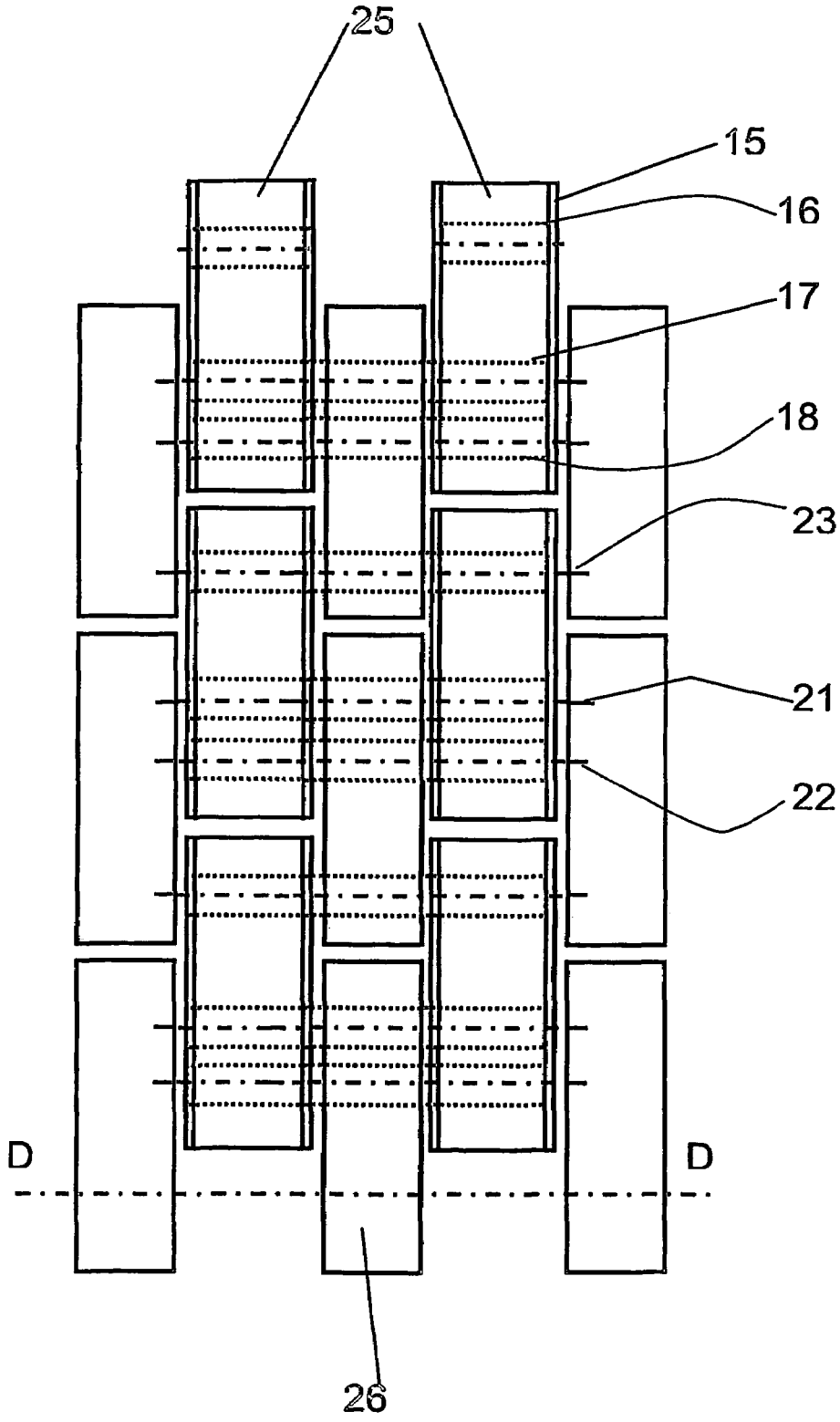

Other features of the invention will become clear from the following description, made with reference to the annexed drawing, in which:

FIGS. 1, 2 and 3 illustrate a first embodiment of a wristband according to the invention, respectively in a top, side and exploded view; and FIG. 4 is a top view of a second embodiment of said wristband.

In a first embodiment, shown in FIGS. 1, 2 and 3, the wristband according to the invention includes a row of central links 10 and two rows of lateral links 11 connecting central links 10 to each other in an articulated manner.

Central links 10 have, overall, the shape of a rectangular plate of oval cross-section. Typically, they have a dimension of approximately 10 mm along longitudinal axis M of the wristband, a dimension of approximately 14 mm widthwise and a thickness of approximately 4 mm.

Links 10 are formed of a core 12, preferably made of carbon fibre, covered with a layer 13 of carbon fibre fabric, for example of the Toron type. Their oval faces 14, parallel to axis M, are respectively coupled, advantageously by bonding, to a metal flange 15, for example made of steel. The shape of these flanges is identical to that of faces 14 and their thickness is approximately 0.7 mm. These elements are mainly used to isolate lateral links 11 from central links 10, in order to protect the latter. Moreover, they contribute to improving the aesthetic appearance of the wristband.

Three passages 16, 17 and 18 pass through each central link 10, parallel to its transverse axis DD, in a plane BB parallel to its median plane CC, but slightly offset towards its internal face (i.e. the face applied to the wrist). Passages 16 and 18 are, respectively, in proximity to front and back edges 19 and 20 of the link parallel to its axis DD, whereas intermediate passage 17 is offset on the side of passage 18.

It is clear that the front edge of a link is that located closest to the upstream side of the wristband, i.e. the end thereof secured to the watch. Conversely, the back edge of a link is that located closest to the downstream side of the wristband, i.e. the end thereof furthest from the watch.

Typically, for a link of 10.2 mm, passage 16 is at 2.5 mm from front edge 19, passage 17 is at 3.95 mm from passage 16 and passage 18 is at 2.20 mm from passage 17.

For reasons that will appear hereinafter, passage 17 has a constant diameter over its entire passage through link 10, typically 1.25 mm, whereas passages 16 and 18 have a slightly greater diameter where they pass through core 12, typically 1.30 mm, but this is reduced where they pass through flanges 15, typically to 1.25 mm.

The articulated connection of two adjacent central links 10 is ensured, around an axis EE corresponding to that of passage 16, by a pair of lateral links 11 facing each other symmetrically with respect to axis AA.

Lateral links 11 are made of metal, for example steel and have, overall, the shape of a plate of oval cross-section having slight concavity towards the wrist. Along longitudinal axis AA of the wristband, they have substantially the same dimension as central links 10 but, widthwise and in the direction of its thickness, they have smaller dimensions, namely, typically, 5.1 mm for the width and 3.7 mm for the thickness.

Each lateral link 11 is pierced, in its median plane FF, by three blind holes 21, 22 and 23 parallel to its transverse axis GG and to transverse axis DD of links 10. These holes are arranged in the following manner:

- the gap between holes 21 and 22 is the same as the gap between passages 17 and 18 of links 10; and
- the gap between holes 22 and 23 is the same as the gap provided between passage 18 of a link 10 and passage 16 of its neighbour.

All three of holes 21, 22 and 23 have the same diameter. It is less than the minimum diameter of the passages of link 10 and typically measures 1.15 mm.

The links of the wristband according to the invention are assembled in the following manner:

- passage 16 of a central link 10 is aligned with holes 23 of a pair of lateral links 11 whose holes 21 and 22 are respectively aligned with passages 17 and 18 of the adjacent upstream central link 10; and
- passages 17 and 18 of the same central link 10 are respectively aligned with holes 21 and 22 of a pair of lateral links 11 whose holes 23 are aligned with passage 16 of the adjacent downstream central link 10.

The articulated connection of the links is ensured by lugs 24 inserted into passages 16, 17 and 18 of links 10 and driven into holes 21, 22 and 23 of links 11. The diameter of these lugs is slightly less than that of passages 16, 17 and 18, namely typically 1.20 mm.

Although, because of their small diameter, lugs 24 rotate freely inside passages 16, 17 and 18, it will be noted that the lugs of passages 17 and 18, arranged in the same central link 10 and driven into holes 21 and 22 of the same pair of lateral links 11, prevent any relative movement between links. The only possible movement is thus that of lugs 24 in passages 16 which thus form the articulation pins between the links of the wristband.

It will also be noted that the larger diameter given to the end passages 16 and 18 of central links 10 allows any dimension and positioning tolerances between cores 12 and flanges 15 to be compensated for.

It will further be noted that the difference in thickness between central links 10 and lateral links 11 and the relative offset between the planes in which their passages and holes are inscribed, cause lateral links 11 to be lowered towards the inside of the wristband, i.e. towards the arm of the person wearing it. Since it is links 10 that pivot with respect to links 11, by pressing on the arm, this movement is thus not completely impeded when the wristband is worn, which contributes to making it pleasant for the person wearing it.

In a second embodiment shown in FIG. 4, where the elements common to FIGS. 1 to 3 are designated by the same reference numbers, the wristband according to the invention differs to that previously described in that it includes two rows of central links 25 separated by a third row of lateral links 26, placed in longitudinal axis AA of the wristband.

Along their transverse axis DD, central links 25 have a smaller dimension than links 10, but, otherwise, they are identical to them.

Lateral links 26 of the third row are identical to links 11 with which they collaborate, in threes, in order to ensure the articulated connection of the two rows of central links 25.

Whichever embodiment is used, it may be advantageous to coat the carbon fibre fabric covering the central links with a layer of varnish. This layer protects the fabric and reinforces the aesthetic appearance of the wristband.

The present description was made with reference to links of constant width whereas, generally, the wristband becomes wider upstream in order to fit the watchcase. It goes without saying that, in order to achieve this fit, one need only gradually increase the width of the lateral links.

Thus, there is obtained an articulated wristband provided with carbon links aesthetically matching a carbon dial and not suffering from the close presence of metal links.

The invention claimed is:

1. A watch wristband comprising:

- a plurality of central links having a defined longitudinal axis, each central link comprising a solid carbon core and a layer of carbon fiber fabric covering said core, said solid carbon core having a first core surface and a second core surface;
- a first pair of lateral links;
- a second pair of lateral links, said first pair of lateral links facing said second pair of lateral links symmetrically with respect to said axis;
- a pair of flanges, one flange being adjacent said first core surface and another flange being adjacent said second core surface; and
- a plurality of lugs connecting each central link to said first pair of lateral links and said second pair of lateral links in an articulated manner, whereby said one flange is connected to said first pair of lateral links and said another flange is connected to said second pair of lateral links.

2. Wristband according to claim 1, wherein said core is made of carbon fibre.

3. Wristband according to claim 2, wherein said flanges are made of metal.

4. Wristband according to claim 1, wherein the central links have the shape of a rectangular plate of transverse section perpendicular to said longitudinal axis.

5. Wristband according to claim 4, wherein three passages pass through each central link parallel to its median plane and to its transverse axis.

6. Wristband according to claim 5, wherein the lateral links have, overall, the shape of a plate of transverse axis parallel to the transverse axis of the central links.

7. Wristband according to claim 6, wherein each lateral link is pierced with three holes parallel to its median plane and to its transverse axis.

8. Wristband according to claim 7, wherein said lugs are arranged in the three passages of the central links and driven into the holes of the corresponding lateral links.

9. Wristband according to claim 7, wherein the holes are arranged such that the first passage of a central link is aligned with the third holes of a pair of lateral links whose second and first holes are respectively aligned with the second and third passages of the adjacent central link.

10. Wristband according to claim 9, wherein the second and third passages of the same central link are respectively aligned with the second and third holes of a pair of lateral links whose third holes are aligned with the first passage of the other adjacent central link.

11. Wristband according to claim 5, wherein the second passage of a central link has a constant diameter whereas the first and third passages have a slightly greater diameter where they pass through the core.

12. Wristband according to claim 5, wherein the central links and lateral links have an oval cross-section.

13. Wristband according to claim 1, further comprising two rows of central links and a third row of lateral links inserted between the central links and fulfilling, on either side, the same connecting function as the other two.

14. A wristband comprising:

a central link comprising a solid carbon core and a carbon fabric covering said solid carbon core, said solid carbon core having a first core surface and a second core surface;

a first flange disposed opposite said first core surface;

a second flange disposed opposite said second core surface;

a first lateral link;

a second lateral link, said first lateral link being disposed opposite said second lateral link;

a third lateral link, said first lateral link being adjacent said third lateral link;

a fourth lateral link, said third lateral link being disposed opposite said third lateral link, said second lateral link being adjacent said fourth lateral link;

a first lug, said first lug connecting a portion of said central link to said first lateral link and said second lateral link, said first lug connecting a portion of said first flange to said first lateral link and a portion of said second flange to said second lateral link;

a second lug, said second lug connecting another portion of said central link to said third lateral link and said fourth lateral link, said second lug connecting another portion of said first flange to said third lateral link and another portion of said second flange to said fourth lateral link, whereby said first flange and said second flange are connected to said central link.

15. A wristband according to claim 14, wherein each central link has the shape of a rectangular plate.

16. A wristband according to claim 15, wherein three passages pass through each central link parallel to its median plane and to its transverse axis.

17. A wristband according to claim 16, wherein the second passage of a central link has a constant diameter whereas the first and third passages have a slightly greater diameter where they pass through the core.

18. A wristband according to claim 16, wherein the lateral links have the shape of a plate.

19. A wristband according to claim 18, wherein each lateral link is pierced with three holes parallel to its median plane and to its transverse axis.

20. A wristband according to claim 19, wherein said lugs are arranged in the three passages of the central links and driven into the holes of the corresponding lateral links.

* * * * *